US008448374B2

(12) United States Patent
Samson et al.

(10) Patent No.: US 8,448,374 B2
(45) Date of Patent: May 28, 2013

(54) ADJUSTABLE BASE FOR AN OPTIC

(75) Inventors: William Samson, Salisbury, MD (US); Rafael Correa, Salisbury, MD (US)

(73) Assignee: Machining Technologies, Inc, Salisbury, MD (US)

( * ) Notice: Subject to any disclaimer, the term of this patent is extended or adjusted under 35 U.S.C. 154(b) by 0 days.

(21) Appl. No.: 13/425,000

(22) Filed: Mar. 20, 2012

(65) Prior Publication Data

US 2012/0317862 A1 Dec. 20, 2012

Related U.S. Application Data

(63) Continuation of application No. 12/317,948, filed on Dec. 31, 2008, now abandoned.

(51) Int. Cl.
*F41G 1/387* (2006.01)

(52) U.S. Cl.
USPC ..... 42/138; 42/125

(58) Field of Classification Search
USPC ..... 42/124, 125, 126, 127, 128, 136, 42/137, 138
See application file for complete search history.

(56) References Cited

U.S. PATENT DOCUMENTS 2,044,855 A * 6/1936 Lundgren ..... 42/137
3,161,960 A * 12/1964 Badali ..... 42/137
3,495,339 A * 2/1970 Elliason ..... 42/137
5,467,552 A * 11/1995 Cupp et al. ..... 42/125

* cited by examiner

*Primary Examiner* — Stephen M Johnson
(74) *Attorney, Agent, or Firm* — F. Wayne Thompson, Jr.

(57) ABSTRACT

A gun sight base which is designed to allow the user to quickly adjust the elevation of the attached gun sight as a means to affect the trajectory of a projectile discharged from the host firearm. Provided is a removable, pre-calibrated adjustment cam which is in operational contact with the attached gun sight. A distance indicator is visible to the user to allow for rapid elevation adjustments without the need for tools.

11 Claims, 8 Drawing Sheets

ADJUSTABLE BASE FOR AN OPTIC

This is a continuation application of U.S. application Ser. No. 12/317,948, filed Dec. 31, 2008, now abandoned the priority of which is hereby claimed.

BACKGROUND OF THE INVENTION

1. Field of the Invention

The herein disclosed invention relates, in general, to optical gun sights for use with a firearm and specifically for optical gun sight mounts.

2. Description of the Prior Art

Telescopic and electronic gun sights for use on rifles and other firearms are well known in the prior art. Adapting these gun sights to various weapons, in general, involves mounting the gun sight containing an image of a red dot or other physical reticule which is used to designate and aim upon a target and a means for mounting the gun sight onto a weapon. In general, the preferred method of securing a gun sight to a mount was through the use of at least one ring which encircles the gun sight and a mount which is designed to be secured to a secondary surface such as a 1913 mil. Std. Rail that is parallel to the bore of the host firearm. These conventional systems rely on the ring or rings which encircle the gun sight to be securely mounted to a base which connects to a secondary surface such as a 1913 mil. Std. Rail commonly found on military and civilian firearms.

In some prior art examples the rings or mount may provide a means for adjustment which allow for horizontal and vertical adjustment of the gun sight to accommodate lateral and vertical changes in the sight line of the gun sight versus the bore of the host firearm. Another popular prior art solution is to provide a means by which the reticule of a gun sight may be adjusted to compensate for windage and elevation to "sight in" the host firearm at a target range after the gun sight has been mounted. These prior art solutions, while providing a means to "sight in" the weapon in a range environment, are not suitable solutions for those needing to adjust the elevation and trajectory of a discharged projectile using the gun sight in a combat or action shooting competition. These prior art solutions often require the use of small hand tools and provide a method of adjustment which is not calibrated for the specific weapon and ammunition being used by the shooter. It would, therefore, be desirable to provide a gun sight mount which allowed for rapid, pre-calibrated adjustments to the elevation of the mounted gun sight. Additionally, this system provides a removable, graduated cam is afforded the user that has visible witness marks present designating the target range that the projectile will impact and does not require the user to use any tools.

Objects and Advantages

Accordingly several objects and advantages of the present invention are (a) To provide an adjustable mount which uses a graduated, pre-calibrated adjustment cam to adjust the mount and thereby the attached gun sight's elevation thus affecting the trajectory of the host firearms discharged projectile.

(b) To provide an adjustment cam which has a series of witness marks visible to the user that specify, in yards or meters, the target range being selected.

(c) To provide an adjustable mount which is robust and does not require tools to affect the elevation of the provided mount.

(d) To provide an adjustable mount which may be adapted to work with various attachment mechanisms used to secure a gun sight to a base to include, but not limited to rings and simple screw attachment methods.

Still, further objects and advantages will become apparent from a consideration of the ensuing description and drawings.

SUMMARY

The present invention is designed to address the problem of adjusting the current target range of a gun sight by providing an apparatus which allows for the rapid adjustment of the target range through the external adjustment of the gun sights elevation, thereby affecting the trajectory of a discharged projectile. The herein described device accomplishes this by providing a vertically adjustable bridge which has a mount platform for the gun sight and may be secured to a base that attaches to the host firearm. From the standpoint of ballistics, the mount is designed to provide the correction in elevation to the scope according with the trajectory of the projectile. The mount has a graduated knob which is integral to the adjustment cam, with set distances, to be selected with one hand from the aiming position. In other words, the distance or target range can be selected while the shooter is looking though the gun sight.

The adjustable bridge is restricted to movement in one plane, which is the projectile trajectory plane and it is spring loaded against the base, forcing it upwardly. The front of the bridge rotates on a roll pin which is supported by the base. The lateral movement is restricted to the cam which confines the lever of the bridge to stay in a groove. The amount of vertical movement allowed to the adjustable bridge is determined by the cam in the shaft of the knob.

The amount of vertical movement afforded the adjustable bridge, or angle of adjustment, is calculated using the real trajectory of the projectile. Trajectory depends on the velocity which the projectile leaves the barrel. Two of the most significant factors concerning velocity variations are the bullet, or projectiles, caliber and the barrel length of the host weapon. Other factors can include temperature, elevation, and bullet shape to name a few, but these factors are not as significant in most cases as caliber and barrel length.

The adjustable mount is designed to be adapted to weapons of differing calibers and barrel lengths by simply removing the adjustment cam assembly and selecting one which is appropriately calibrated for the firearm in use. The adaptability of the optic and associated mount is significant considering that the cost of these items can equal or exceed, in some instances, the price of the firearm it is designed to be used with. The knob of the cam is labeled with the appropriate caliber and barrel length information to make identification easy.

The knob of the adjustment cam assembly has pre-set positions easy to select by a simple rotation of the knob. A spring loaded ball detent applies pressure against the base and a series of depressions prevent the knob from unintentional rotations or skipping resulting from vibration.

From the above, it may be seen that the present invention provides for a means of allowing quick adjustments in the vertical alignment of a gun sight with the bore of a weapon. Also provided is a means to calibrate the quick adjustments in vertical alignment to specific caliber and barrel length combinations through the use of pre-set adjustment cam assemblies. Many other features and uses will become obvious to one skilled in the art upon examination of the attached detailed description and the associated claims.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
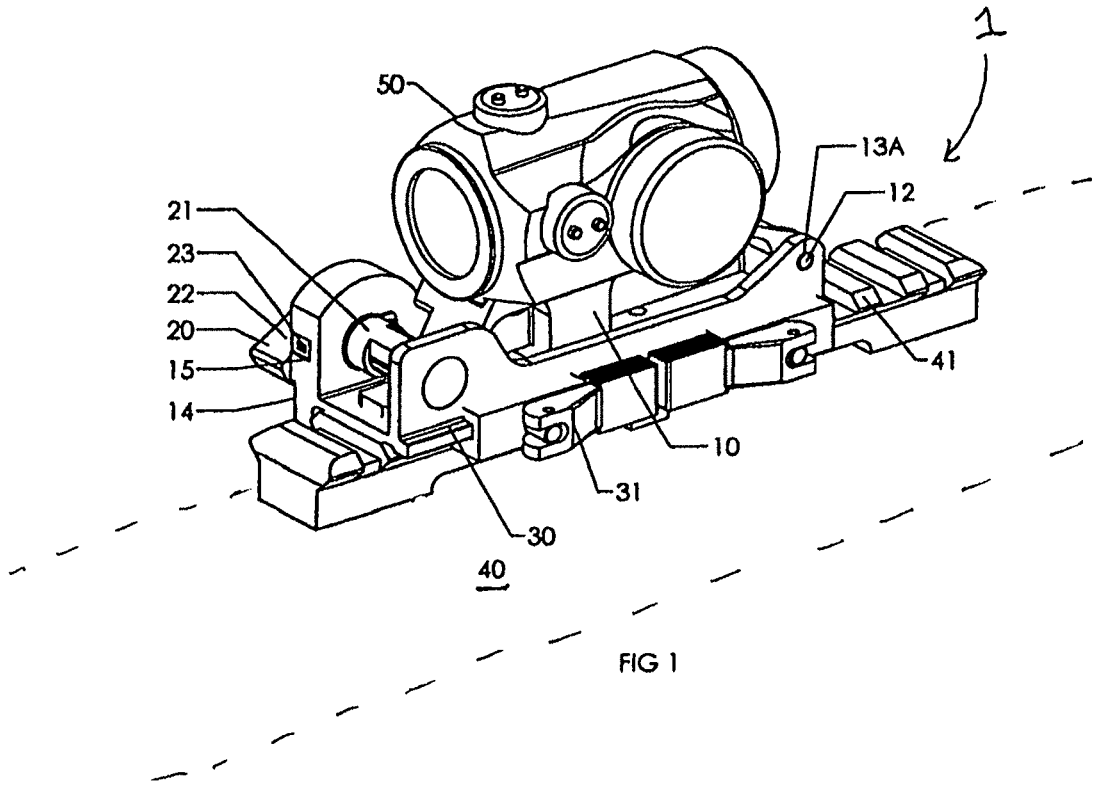
FIG. 1 is an illustration showing an adjustable base for an optic on a firearm upper receiver, with an optic in place, according to the principles of the invention.
Figure 2:
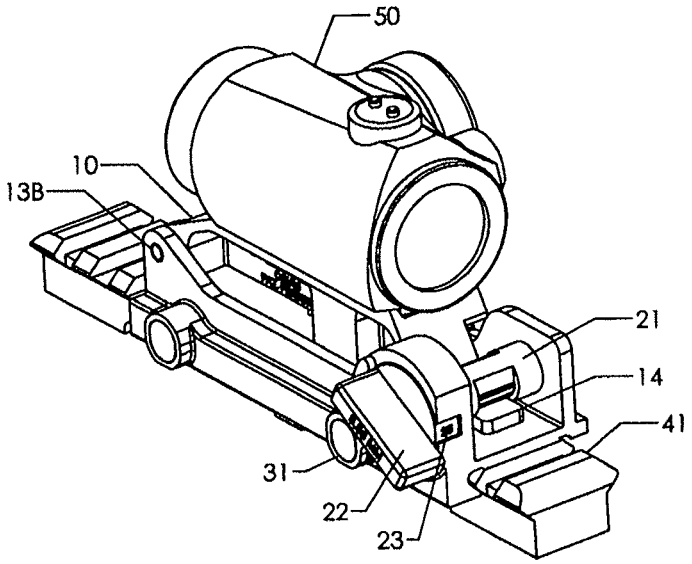
FIG. 2 is a perspective side view of the herein described invention.
Figure 3:
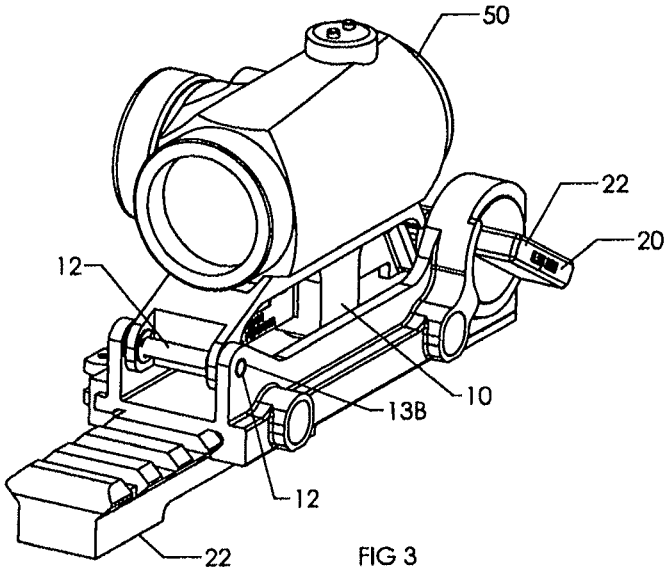
FIG. 3 is a side perspective view thereof rotated 180 degrees from the illustration in FIG. 1.
Figure 4:
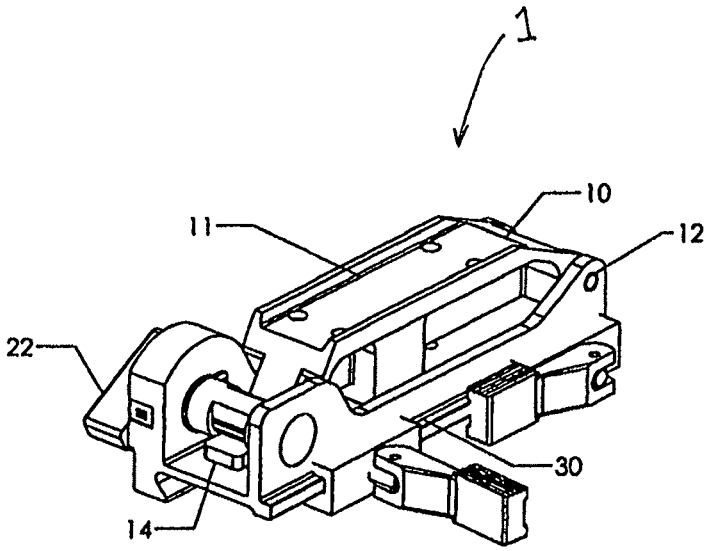
FIG. 4 illustrates a side view of the adjustable base for an optic.

Now referring to the drawings, the adjustable base assembly of the present invention, generally designated by reference numeral 1, for an optic 50, is shown and generally illustrated in the figures. While the assembly may include several components and auxiliary attachments to tailor the assembly for the particular application, in the simplest form, the present invention provides for a device utilizing a spring loaded rail which is in operational connection with a cam that allows the user to adjust the elevation of an auxiliary sighting device, specifically an electronic optic with a firearm. In the preferred embodiment, the required components include at least an adjustable gun sight bridge 10 with an optic mounting platform 11, and an adjustment cam 20, and a base 30 which interfaces with the host firearm. Additionally, other components that may be utilized in the assembly as required by the particular application include a throw lever retention system 31 or simply screws.

As was stated above, the adjustable base assembly 1 for an optic is designed to be used with a variety of sighting scopes such as the types typically used on any variety of prior art firearms including, shotguns, and rifles. Further, the terms "scope" or "gun sight" or "optic" as used herein, are to be understood as including all types of auxiliary sighting devices capable of being mounted on a firearm that are utilized in place of the standard iron sights already found on the firearm as manufactured, including but not limited to telescopic sights, electronic sights, night vision devices, range finding and illuminating devices. Also, as used herein, "fore end" or "front end" refers to the end of a component nearest the muzzle of the firearm, while "rear end" refers to the end of the component nearest the shooter or user.

The primary objective of the adjustable base assembly 1 for an optic of the present invention is the provision of a spring loaded adjustable gun sight bridge 10 connected to an optic mounting platform 11 where the angle of the platform is changed by the rotation of an adjustment cam 20. The adjustment cam 20 is removable and provides calibrated adjustments for the user to select from. This is an important feature because as stated above many electronic sights do not have built in bullet drop compensators or a ready means by which elevation might be adjusted.

Turning now to the drawings in which like reference characters indicate corresponding elements throughout the several views, attention is directed to FIGS. 1-4. There is illustrated a firearm upper receiver 40 with an integral 1913 mil. std. rail 41. A means to secure the base 30, to the 1913 mil. std. rail 41, is provided in the form of self adjusting throw levers 31. The base 30 has an adjustable gun sight bridge 10 which pivots on a fixed roll pin located between two thru holes 13A and 13B located at the front end of the adjustable base assembly 1. An optic mount platform 11 (FIG. 4) is provided to allow for the mounting of an electronic gun sight 50. The rear end of the adjustable gun sight bridge 10 has an indexing hook 14 which interacts with the elevation cam 21. The adjustment knob 20 consists of three parts: the knob 22, the elevation indicator 23 and the elevation cam 21 which may be rotated through use of the provided knob 20. An opening 15 is provided in the adjustable base assembly 1 for an optic 50 to allow the elevation indicator 23 on the adjustment knob 20 to be seen by the user.

Figure 5:
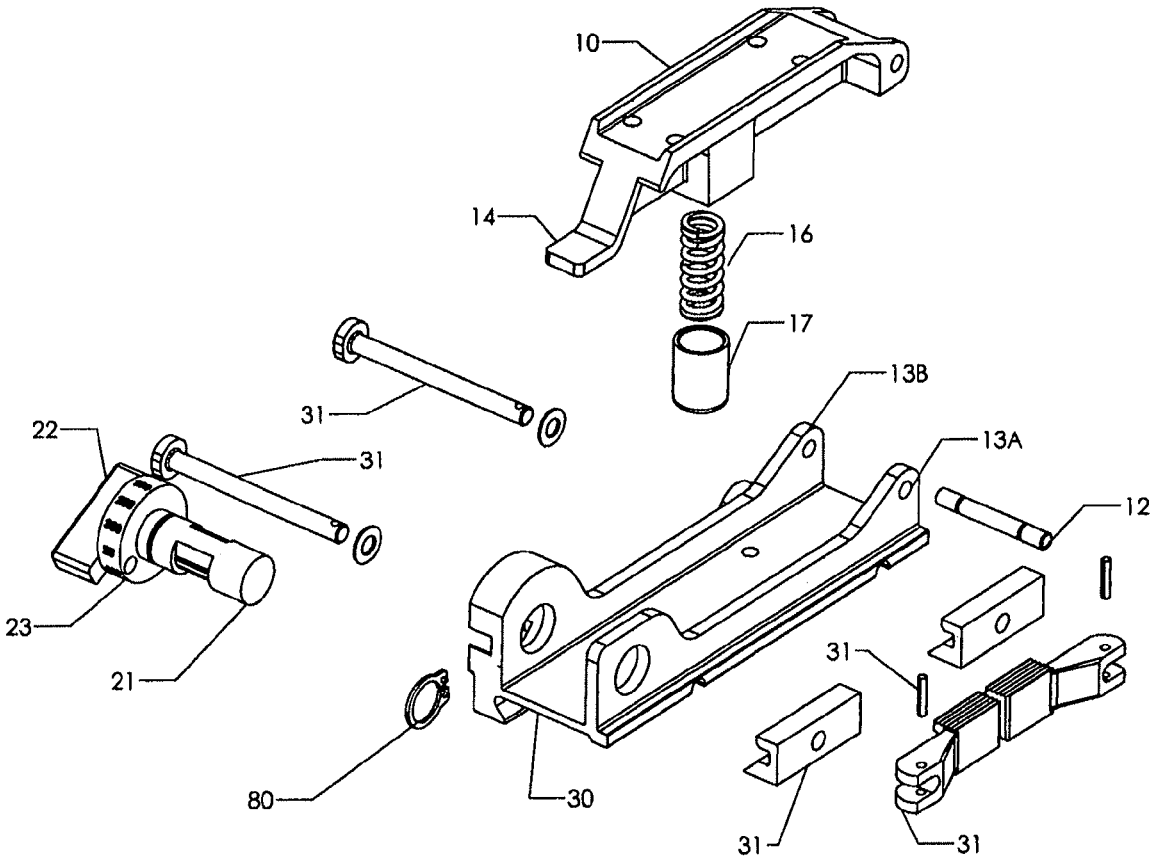
FIG. 5 depicts an exploded perspective view thereof.
Figure 6:
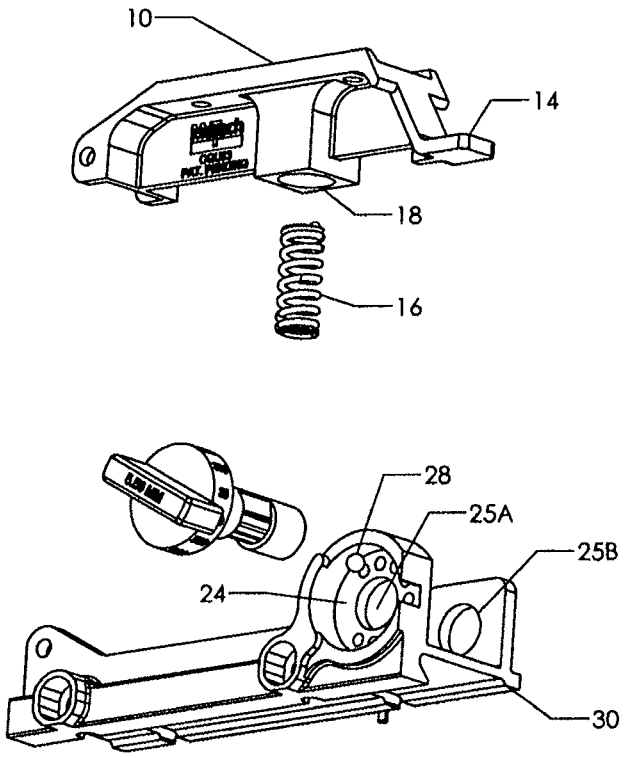
FIG. 6 depicts a view thereof rotated approximately 90 degrees.
Figure 7:
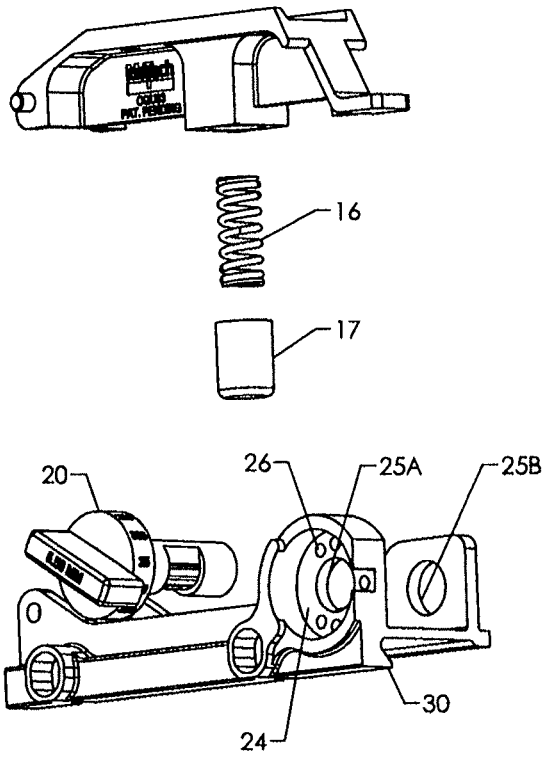
FIG. 7 is side perspective view thereof rotated 180 degrees from the illustration in FIG. 5.
Figure 8:
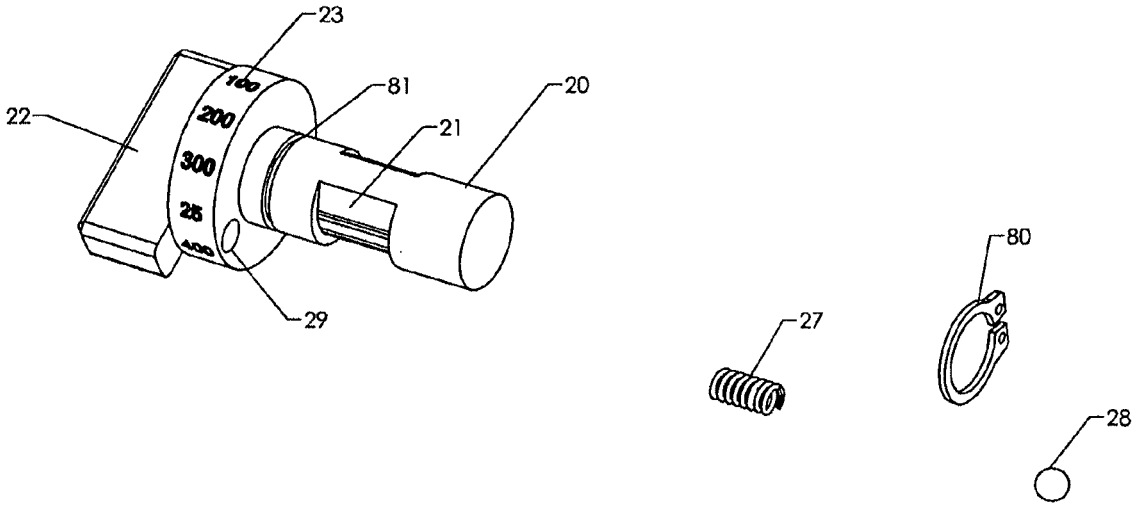
FIG. 8 illustrates a side perspective view of the adjustment cam assembly.

FIGS. 5-7 show an exploded view of the herein described device from three different angles. The attachment means 31 is comprised of a variety of parts which make up a throw lever system. This system is known in the prior art but nothing about its use is meant to imply that it is the only attachment means which may be used to secured the base 30 to a secondary surface such as a firearm upper receiver 40. FIGS. 7-8 have the attachment means 31 omitted from their respective views for purposes of clarity. Also illustrated are the spring 16, support detent 17 and the bottom opening 18 in the adjustable gun sight bridge 10 which houses these parts when the device is assembled and in operation.

Best illustrated in FIGS. 6-7 is the adjustment cam 20 opening 24 and the thru holes 25A and 25B which retain the adjustment cam assembly 20 in place. A series of detent holders 26 are present about the interior surface of the adjustment cam opening 24. A spring 27 and ball detent 28 are present and fully shown in FIG. 8.

Depicted in FIG. 8 are the adjustment cam assembly 20, spring 27, ball detent 28, and the retainer clip 80. The adjustment cam assembly 20 consists of the elevation cam 21, knob 22, elevation indicator 23, recess 29 which houses the spring 27 and ball detent 28, and a groove 81 which interacts with the retainer clip 80.

The base 30 has a means by which it may be secured to the upper receiver 40 of a firearm or other secondary surface, shown herein in the form of a throw lever retention system 31. An adjustable gun sight bridge 10 is connected to the base 30 by a roll pin 12 which slides through the front end of the bridge 10 and the thru holes 13A and 13B of the base 30. The rear end of the bridge 10 has an indexing hook 14 which is curved down. On top of the adjustable gun sight bridge 10 is an optic mounting platform 11 which provides a place to secure the electronic optic 50. On the bottom of the bridge 10 is an opening 18 which houses a spring 16 and support detent 17.

On the rear of the base 30 are two thru holes 25A and 25B and an adjustment cam opening 24 which houses the adjustment cam assembly 20. About the interior of the adjustment cam opening 24 are a series of detent holders 26 which interact with the spring 27 loaded ball detent 28 sandwiched between the knob 22 of the adjustment cam assembly 20 and the adjustment cam opening 24. The spring loaded ball detent 28 prevents the unintentional movement of the adjustment cam assembly 20 by interacting with the detent holders 26.

The adjustment cam assembly consists of the knob 22, elevation indicator 23 and the elevation cam 21. A retainer clip 80 interacts with a groove 81 present about the exterior of the adjustment cam assembly 20 and secures the assembly in place.

Elevation cam 21 is in operational contact with the indexing hook 14 located at the rear end of the adjustable gun sight bridge 10. As the knob is rotated clockwise the elevation cam 21 places downward force on the indexing hook 14 thereby lowering the rear of the gun sight bridge 10. While the elevation cam 21 is pushing on the indexing hook 14 the spring 16 and support detent 17 housed under the bridge 10 in the opening 15 are being compressed. This provides an opposing direction of force against the movement resulting from the interaction of the elevation cam 21 and the indexing hook 14 and keeps the bridge 10 in a secured position. The pre-calibrated adjustment cam assembly 20 has an elevation indicator 23 which is displayed through an opening 15 in the base 30. The knob 22 may be turned counter-clockwise to release the pressure placed on the indexing hook 14 and allow the spring 16 and support detent 17 to elevate the rear of the adjustable gun sight bridge 10.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

CONCLUSION, RAMIFICATIONS AND SCOPE

Accordingly the reader will see that I have provided an adjustable sight mount for an optical gun sight which has been adapted to work with various prior art attachment mechanisms. A removable, pre-calibrated cam assembly is used to adjust the firing trajectory of the host weapon by adjusting the angle of the attached electronic sight in relationship to the firearms bore. The war fighter is provided with an elevation indicator so that he will know at what range the projectiles will be point of aim, point of impact. The adjustable gun sight bridge may be adapted to other prior art mounts and used with a variety of different optics currently available on the market. No tools or other items are required for the war fighter to use this device.

Another embodiment of the adjustable sight mount could use thumb screws to secure the base to a firearm or other secondary structure. Further, a longer base could be utilized so that a traditional magnified optic could be secured to an extended adjustable gun sight bridge.

While my above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents.

What is claimed is:

1. An adjustable base assembly for an electronic optic to be mounted on a firearm, comprising:

a base attachable to a firearm;

an adjustable bridge having a bore formed on a bottom portion, a front end pivotally mounted to said base thereby allowing a rear end with a rearwardly directed indexing hook to move up and down, said rear end being biased upwardly by a spring, the spring having an upper portion that is received within said bore and a lower portion supported on said base so that said spring is positioned between said bridge rear end and said base;

an optic mounting platform mounted to or integral with said bridge and configured to secure an electronic optic and prevent movement thereof relative to said platform; and an adjustment cam assembly mounted to said base and having an elevation cam operatively coupled to said rearwardly directed indexing hook on the rear end of said bridge, said adjustment cam assembly including an element manipulated by a user rotatable in both clockwise and counter-clockwise directions to adjust an angle of said bridge to change an elevation of said optic mounted on said optic mounting platform, movement in a first of said directions causing said elevation cam to increase downward pressure on said rear end indexing hook to compress the spring and lower the rear end of the bridge, movement of the element in a second opposite direction decreasing the pressure applied by the elevation cam to allow the rear end to move upwardly by the biasing force of the spring, wherein said element manipulated by the user is a knob.

2. The adjustable base assembly as set forth in claim 1, wherein said adjustment cam assembly is removable.

3. The adjustable base assembly as set forth in claim 1, wherein said adjustment cam assembly includes an elevation indicator having indicia thereon to indicate to the user the angle of the bridge as set by the elevation cam of the adjustment cam assembly.

4. The adjustable base assembly as set forth in claim 1, wherein the adjustable bridge pivots on a pin that secures said bridge to the front end of the base.

5. The adjustable base assembly as set forth in claim 1, wherein said spring is compressed against said base when said knob is turned in said first direction.

6. The adjustable base assembly as set forth in claim 1, wherein said base includes an upwardly extending arm having an adjustment cam opening therethrough, said elevation cam of said adjustment cam assembly being received within said adjustment cam opening to be substantially perpendicular to said arm and said knob being coupled to an end of said elevation cam protruding from said adjustment cam opening.

7. The adjustable base assembly as set forth in claim 6, wherein said adjustment cam assembly includes an elevation indicator having indicia thereon to indicate to the user the angle of the bridge as set by rotating the knob to concurrently rotate the elevation cam.

8. The adjustable base assembly as set forth in claim 7, wherein said arm has a cutout aligned with said indicia to enable the user to see the indicia on the elevation indicator.

9. The adjustable base assembly as set forth in claim 6, wherein an interior of said adjustment cam opening includes a plurality of detent holders, said adjustable base assembly further including a spring loaded detent that movably engages with a respective one of said detent holders when said adjustment cam assembly is manually rotated, said engagement preventing unintentional rotation of said elevation cam.

10. An adjustable base assembly for an electronic optic to be mounted on a firearm, comprising:

a base attachable to a firearm having an upwardly extending arm with an adjustment cam opening therethrough;

an adjustable bridge having a bore formed on a bottom portion, a front end pivotally mounted to said base and a rear end having an indexing extension;

a spring received within said bore and having a lower end in abutment with said base, said spring upwardly biasing said rear end of said bridge;

an optic mounting platform mounted to or integral with said bridge and configured to secure an electronic optic and prevent movement thereof relative to said platform;

an adjustment cam assembly having a knob and an elevation cam, said elevation cam is substantially perpendicular to said arm when it is received within said adjustment cam opening, said knob being coupled to an end of said elevation cam that protrudes from said adjustment cam opening;

said elevation cam is operatively coupled to said indexing extension, said knob and thereby said elevation cam being rotatable in one direction to increase downward pressure on said indexing extension to lower said bridge rear end, and being rotatable in an opposite direction to decrease said downward pressure and allow said rear end of said bridge to move upwardly in response to said spring bias.

11. The adjustable base assembly as set forth in claim 10, wherein said adjustment cam assembly includes an elevation indicator having indicia thereon to indicate to the user the angle of the bridge as set by rotating the knob to concurrently rotate the elevation cam.

* * * * *